US006247178B1

(12) United States Patent
Bilda

(10) Patent No.: US 6,247,178 B1
(45) Date of Patent: Jun. 19, 2001

(54) CONVERTIBLE, SCENT RETAINING GARMENT/BLANKET

(76) Inventor: Victoria J. Bilda, 4741 N. Friess Lake Dr., Hubertus, WI (US) 53033

( * ) Notice: Subject to any disclaimer, the term of this patent is extended or adjusted under 35 U.S.C. 154(b) by 0 days.

(21) Appl. No.: 09/280,952

(22) Filed: Mar. 29, 1999

Related U.S. Application Data

(60) Provisional application No. 60/080,390, filed on Apr. 2, 1998.

(51) Int. Cl.[7] ..... A41B 1/00

(52) U.S. Cl. ..... 2/69; 2/53; 2/73; 2/267; 2/59; 2/126

(58) Field of Search ..... 2/53, 54, 59, 69, 2/69.5, 86, 95, 103, 123, 124, 125, 126, 128, 265, 912, 73, 267

(56) References Cited

U.S. PATENT DOCUMENTS 2,670,470 * 3/1954 Manheim et al. ..... 2/70
2,677,131 * 5/1954 Shuster ..... 2/126
4,977,622 * 12/1990 Schley ..... 2/59
4,995,115 * 2/1991 Ellis ..... 2/69
4,999,850 * 3/1991 Grilliot et al. ..... 2/126
5,131,096 * 7/1992 Olson ..... 2/75
5,423,711 * 6/1995 Dorland ..... 450/57

* cited by examiner

*Primary Examiner*—John J. Calvert
*Assistant Examiner*—Robert H. Muromoto, Jr.
(74) *Attorney, Agent, or Firm*—Jansson, Shupe, Bridge & Munger, Ltd.

(57) ABSTRACT

The invention is an improved process for promoting bonding between parent and infant. The invention is also a garment for use with this process. The garment is a shirt made from scent-absorbing fabric. The shirt's sleeves and torso portion are secured together using hook and loop fasteners, allowing the sleeves to be detached. The parent wears the shirt for a period of time long enough for the shirt to absorb the scent. The parent then detaches a sleeve, using it or the torso of the garment to form an infant's blanket. After wrapping the infant in the blanket, the parent can then leave the infant in the care of someone else, and the infant will still be able to smell the scent of the parent.

15 Claims, 4 Drawing Sheets

CONVERTIBLE, SCENT RETAINING GARMENT/BLANKET

RELATED APPLICATION

This application is based upon U.S. provisional patent application Ser. No. 60/080,390 filed Apr. 2, 1998.

BACKGROUND AND SUMMARY OF THE PRESENT INVENTION

The present invention relates to garments, and to the process of promoting bonding between parent and child by providing the child with a garment having the parent's scent. Specifically, the invention is a garment, capable of absorbing bodily scents, convertible into an infant's blanket. The invention is also an improved, more hygienic process of absorbing the parent's scent and placing it before the child.

Garments which convert from one use to another by detaching various portions have been invented before, but have primarily been used for purposes of either fashion or reducing the need to carry other garments. One example is U.S. Pat. No. 2,670,470, which issued to Karl Manheim and Eyn Ayala, disclosing a coat with a detachable lower section which could be used as a sleeping bag, and which had a detachable, inflatable collar. Its purpose is to provide soldiers with a single multi-purpose garment to replace several different items the soldier would otherwise have to carry. Additionally, U.S. Pat. No. 2,677,131, issued to Sidney M. Shuster disclosing a shirt with removable sleeves, was intended primarily to accommodate a 1950's fashion trend. Verne L. Stephenson disclosed in U.S. Pat. No. 2,720,654 a blanket which could be converted into a cape or bag. U.S. Pat. No. 2,911,648, issued to Maria Schanda-Seyferth, discloses another coat which converts to a blanket. None of these patents discloses the use of scent-absorbing materials in a garment convertible to an infant's blanket in order to promote bonding between a parent and child.

An example of a convertible garment relating to infant care is disclosed by Sydelle S. Shapiro in U.S. Pat. No. 2,879,514. The garment is an apron for protecting the wearer's clothing while bathing an infant, which then coverts to a towel for drying the infant.

Some patents have been issued for inventions designed to improve bonding between parents and infants. One example, U.S. Pat. No. 4,776,546, issued to Alfred L. and Amy Goldson, discloses a bib holding an infant's bottle in a mammary-like pouch. The patent claims that it improves bonding between the father and child by anatomically simulating the mother. The second is U.S. Pat. No. 4,989,285, issued to Jennelle N. and Gregory A. Troncone, disclosing a blanket made from two layers of fabric, joined only along the edges, with a low coefficient of friction between them, intended to simulate the feeling of amniotic fluid. More recently, U.S. Pat. No. 5,423,711, issued to Gabrielle J. Dorland, discloses a garment with removable pads made from scent-absorbing material, which is first worn by the mother, then attached to the infant's bed or other location, so that the infant continues to smell the scent of its mother.

Unlike the current invention, the Dorland invention suffers from the disadvantage of possible contamination of fabric by excreted bodily fluids. Dorland teaches that the scent-absorbing material should be placed over the mother's breasts. Her reasoning is based on research showing that the mother's scent is stronger in this location, and that the scent is used to draw the baby's head towards the breast for feeding. However, placing the scent-absorbing material directly over the breasts creates a risk that the material would absorb leakage from the breasts. If such material were given to the infant, and U.S. Pat. No. 5,423,711 is correct about infants bringing their head towards the scent of the breasts, the baby would be likely to start sucking on the contaminated material.

To avoid fluid contamination, the present invention uses a garment made from the scent-absorbing material placed away from any location where fluid discharges can occur. The garment itself then coverts into a blanket for the infant. The blanket avoids the time-consuming task of attaching the scent-absorbing material to a bed. It also allows the infant to be wrapped in the blanket before separation from the mother, rather than forcing the baby to wait. The infant need not be in a bed, swing, or other fixed location in other to smell its mother, but may be wrapped in the blanket while being held by another person. Most importantly, such a blanket could be used in a delivery room without fear of fluid contamination before the baby is removed so the mother can rest. No hospital is likely to allow anything, including the prior art, to be given to a patient if there is a risk of contamination by bodily fluids.

None of the above inventions and patents, taken either singly or in combination, is seen to describe the instant invention as claimed.

The invention is a portion of an adult garment which is capable of absorbing the scent of the adult wearer and then being converted to an infant's blanket to promote bonding between the wearer and the infant, and to provide the infant with a feeling of security derived from the scent of a familiar person. The invention is also an improved process for creating a bond between parent and child.

The garment in the preferred embodiment is a shirt or sweater made from a material which is capable of absorbing bodily scents. The shirt comprises a torso portion, and two detachable sleeves secured to the torso portion by hook and loop fasteners. In the preferred embodiment, at least one of the sleeves includes a lengthwise seam fastened with hook and loop fasteners, so that separating the seam forms a blanket. The sleeve also includes a cuff which is folded back and held in place by hook and loop fasteners while worn as a shirt. When the sleeve is made into a blanket, it can be extended to form a hood.

Instead of using the sleeve to form a blanket, the shirt can be constructed so that the torso portion can be used. As before, the sleeves are fastened to the torso portion using hook and loop fasteners, and are detached prior to converting the shirt to a blanket. In this embodiment, the torso portion includes a front and back panel joined along the sides by hook and loop fasteners. The front and back panels are separated, and either the front or back can be used as a blanket. The back panel can include a hood for the infant's head.

As an alternative to hook and loop fasteners, snaps may be used.

In use, the shirt is first washed in the normal detergent used for the baby's clothes. It is then worn by the person with whom bonding is desired, usually the mother, immediately after showering, for a period of time sufficient to absorb the person's scent. If the torso portion of the shirt is used to form the blanket, and the wearer is pregnant, an undergarment should be worn while wearing the shirt to prevent the shirt's contamination by leakage from the wearer's breasts. The sleeves of the shirt are then detached. Either the sleeve or torso portion of the shirt is then separated along its seam to form a blanket, as described above. After the smell has worn off the blanket, the garment is washed, and can be re-used.

Garments other than a shirt could certainly be similarly adapted. Whatever garment is used, the detachable blanket portion is formed of the portion of the garment which avoids placement directly against any portion of the adult body likely to discharge fluid.

Accordingly, it is a principal object of the invention to provide an improved process for creating a bond between a parent and child by allowing the child to smell the parent's scent when the parent is away. It is another object of the invention to provide a feeling of security for the infant by ensuring that it can smell a familiar person.

It is a further object of the invention to provide a garment which will absorb the parent's scent without the risk of absorbing bodily fluids which may be unhealthy for the child, so that the garment will be allowed into a hospital delivery room.

Still another object of the invention is to provide the above garment in a form which can be converted to a blanket, avoiding the necessity of attaching it to a fixed location, allowing for easy portability, allowing the infant to smell the scent while being held by another person.

It is an object of the invention to provide improved elements and arrangements thereof in an apparatus for the purposes described which is inexpensive, dependable and fully effective in accomplishing its intended purpose.

These and other objects of the present invention will become readily apparent upon further review of the following specification.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

Similar reference characters denote corresponding features consistently throughout the attached drawings.

DETAILED DESCRIPTION OF THE DRAWINGS

The invention comprises a convertible garment intended to promote bonding between parent and child, and to provide a feeling of security for the child when the parent and child are separated. The garment is worn by the person with whom bonding is desired (usually, but not necessarily, the mother) for a period of time sufficient to absorb the scent of the wearer. The wearer than removes the garment, coverts it into a blanket, and wraps it around the infant. The infant can now smell the wearer's scent when the wearer departs.

Figure 1:
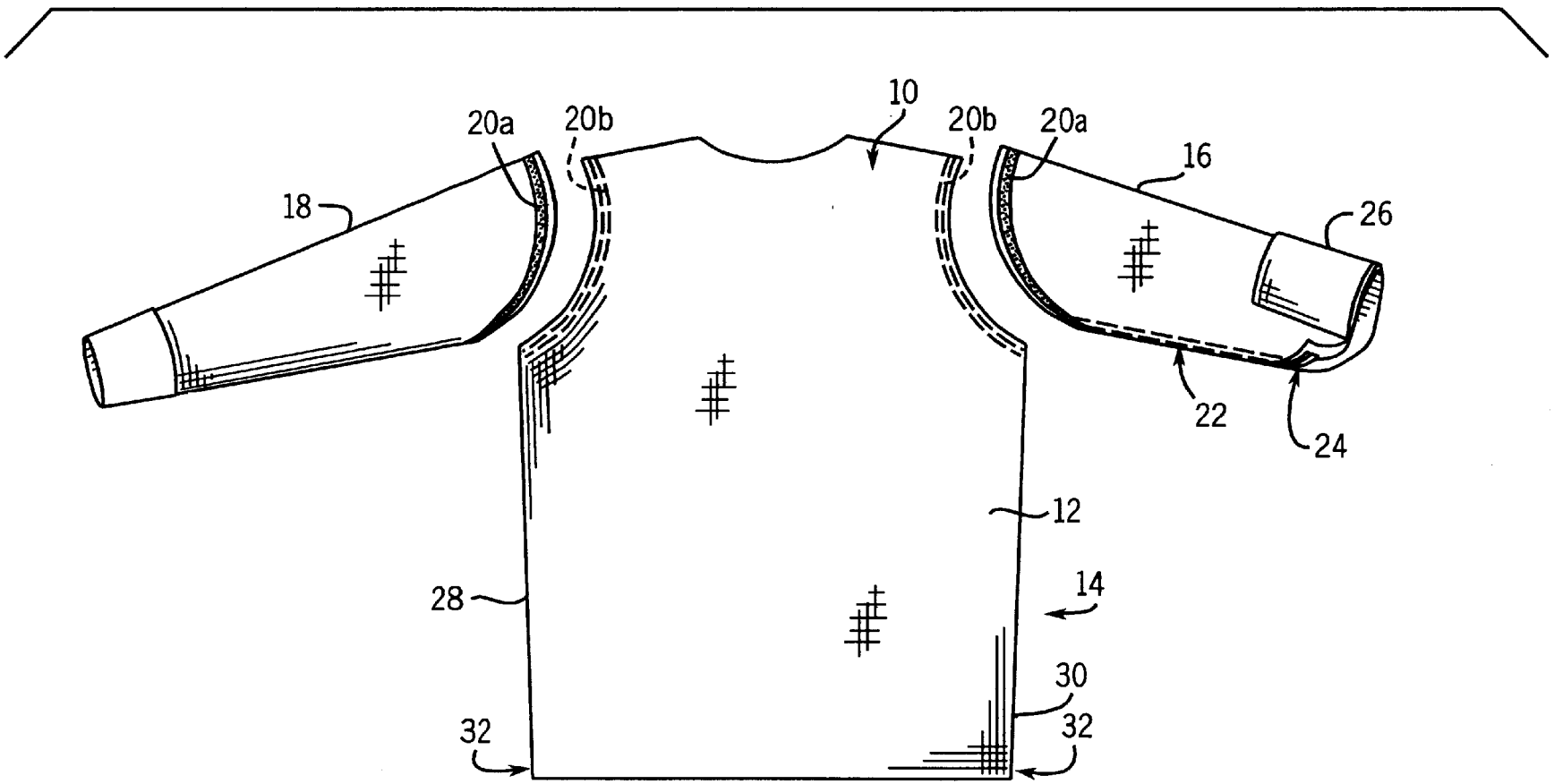
FIG. 1 is a partially exploded view of an adult garment with the sleeves detached in preparation for use of either the sleeve or torso portion as an infant's blanket.

Referring to FIG. 1, a first embodiment of the garment is a shirt comprising a torso portion 10, with a front and back panel, 12 and 14, respectively, and detachable sleeves, 16 and 18. The sleeves are attached to the torso portion using hook and loop fasteners, comprising mating parts 20*a* and 20*b*, located on the outside of the sleeve and inside of the torso portion, respectively. In the preferred embodiment, at least one sleeve includes a lengthwise seam, 22, which is closed by mating portions of a second hook and loop fastener 24. To form a blanket from a sleeve, the seam 22 is separated. Each sleeve 16, 18 may also include a cuff 26. The cuff 26 is held folded back by hook and loop fasteners 27, when in the form of a shirt, and can be unfolded so that cuff 26 forms a hood for the infant.

Figure 2:
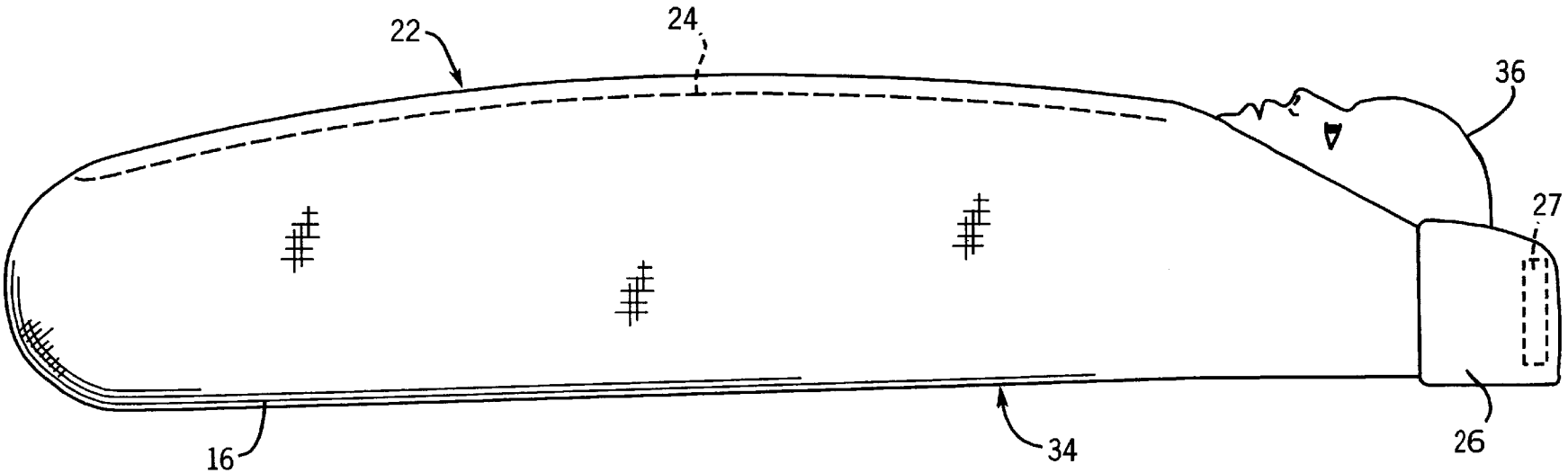
FIG. 2 is an elevational view of a portion of an adult garment being used as an infant's blanket.

Referring to FIG. 2, the infant 34 is loosely wrapped in the blanket formed from detachable sleeve 16. The cuff 26, as can be easily envisioned, may be unfolded to form a hood around the infant's head 36. The use of a sleeve has the advantage of keeping that portion of the garment which will be used as a blanket away from the breasts, where fluid discharges can occur in pregnant mothers.

Figure 3:
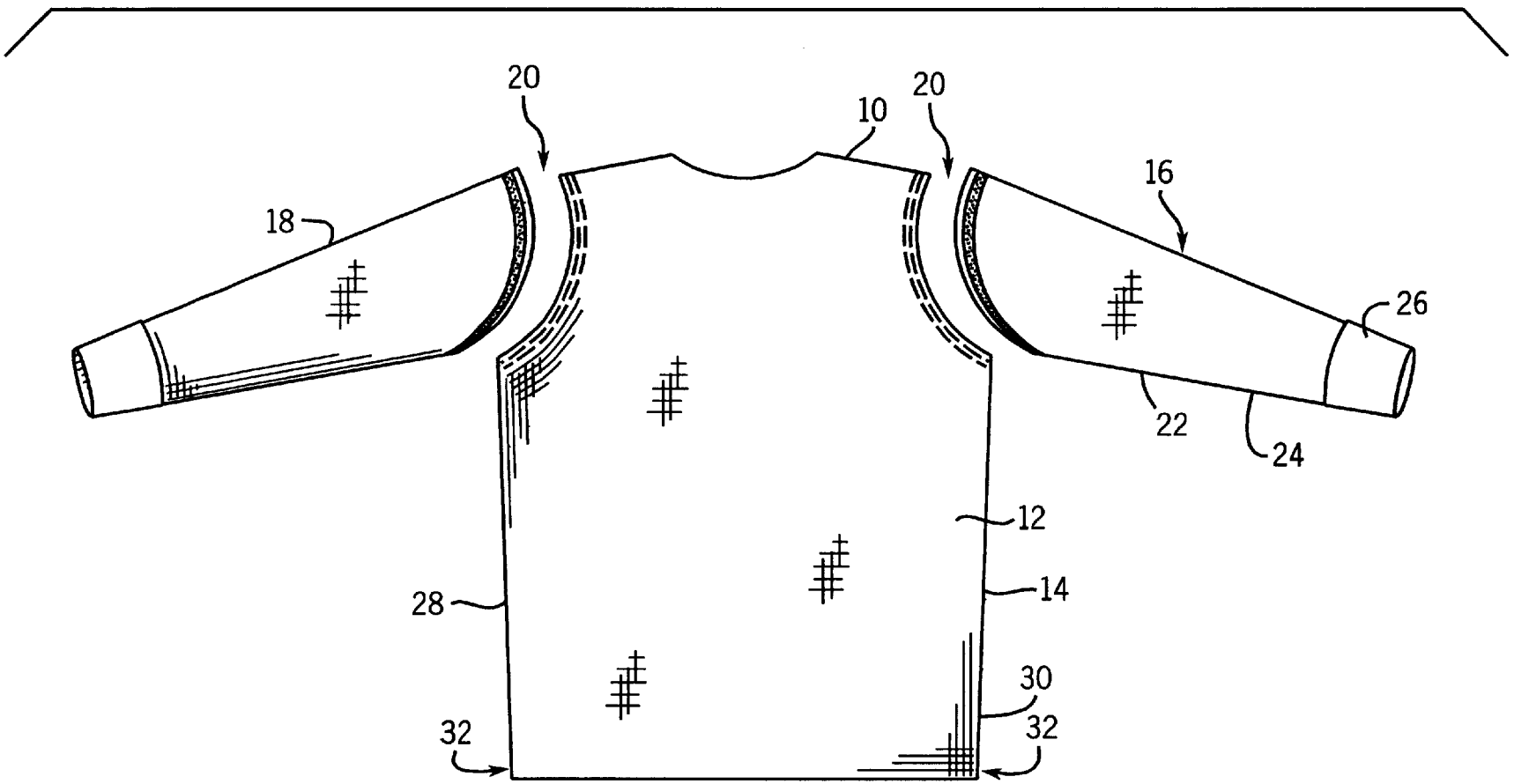
FIG. 3 is a partially exploded view of an adult garment with the sleeves detached.
Figure 4:
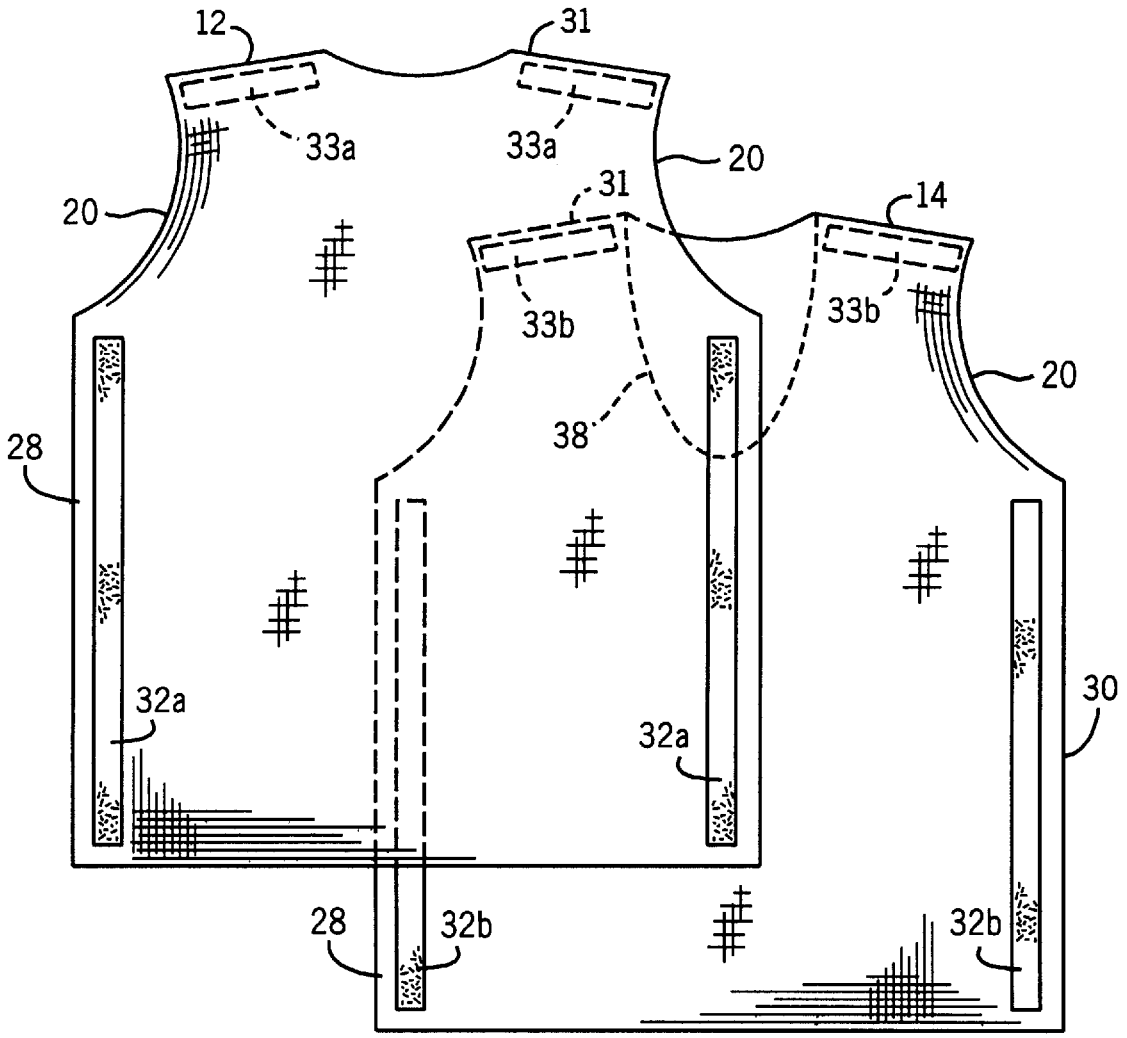
FIG. 4 is a partially exploded view of a second embodiment of an adult game with the front and back panels of the shirt's torso portions detached in preparation for the use of either panel as the blanket.

The shirt can also be constructed so that the torso portion 10 can form a blanket. Referring to FIG. 3, the front and back panels 12 and 14 can be seen more clearly attached to each other along their sides 28 and 30, with mating components of a hook and loop fasteners 32*a* and 32*b*, and also along the top 31, with mating components of a hook and loop fastener 33*a* and 33*b*. After separating the front and back panels, either the front panel 12 or back panel 14 can be used as a blanket by wrapping it around the infant. The back panel 14 is preferably used in accordance with the purpose of minimizing contact with bodily fluid discharge. The back panel may also include a hood 38 for the infant's head.

The sleeves, and any seams intended to separate, must be fastened with a fastener which will not endanger the infant. For example, buttons cannot be used because they can become separated from the garment, creating a choking hazard for the infant. Hook and loop fasteners or snaps are preferred to avoid this hazard.

The present invention also includes an improved process for creating a bond between parent and child, and also a garment for use with this process. To follow the process, one wears a shirt capable of absorbing bodily scents for a period of time sufficient to allow the shirt to absorb one's scent. While being worn, the shirt is in contact with the skin, but kept away from any location where fluid discharge other than perspiration might occur. If the torso portion 10 of the shirt is to become the blanket, an undergarment should be worn to protect the shirt from leakage from the breasts if the wearer is pregnant. The wearer also should avoid strenuous activity to minimize perspiration while wearing the shirt.

After sufficient time has passed, one removes the shirt, and detaches the sleeve 16 or 18 or the front or back torso portion of the shirt 12 or 14, as described above. Separating the hook and loop fasteners 24 or 32*a–b*, results in a flat cloth which can be used as an infant's blanket. One wraps the infant in the resulting blanket, allowing the infant to smell the wearer's scent. If preferred, one can unfold the cuff of the sleeve 26 to form a hood for the infant. One can then leave the infant in someone else's care, and the infant will be comforted by the scent of a parent.

The preferred procedure includes washing the shirt in the detergent usually used for the infant's clothing, washing oneself, applying one's usual deodorant, lotion, powder, and/or perfume, wearing the shirt for a period of two to five hours, and then detaching the blanket portion of the shirt.

It is to be understood that the present invention is not limited to the sole embodiments described above, but encompasses any and all embodiments within the scope of the following claims.

Various modes of carrying out the invention are contemplated as being within the scope of the following claims particularly pointing out and distinctly claiming the subject matter which is regarded as the invention.

I claim:

1. A shirt-like garment which is convertible to a blanket for a babe, the shirt-like garment being adapted to be worn by an individual, comprising:

a torso portion formed from a scent-absorbing material, the torso portion positionable over the torso of the individual in spaced relation thereto to prevent contact of the torso portion with the torso of the individual;

a sleeve of scent-absorbing material removably attached to the torso portion, the sleeve terminating at a cuff, having a longitudinal seam, and being openable along the longitudinal seam for use as the blanket;

a sleeve connection structure for removably connecting the sleeve to the torso portion; and a seam connection structure for forming the longitudinal seam of the sleeve;

wherein the blanket is free of straps projecting therefrom.

2. The shirt-like garment of claim 1 wherein the sleeve connection structure includes a hook and pile fastener.

3. The shirt-like garment of claim 1 wherein the seam connection structure includes a hook and pile fastener.

4. The shirt-like garment of claim 1 wherein the cuff of the sleeve is openable to form a hood for the blanket.

5. A shirt-like garment which is convertible to a blanket for a baby, the shirt-like garment being adapted to be worn by an individual, comprising:

a torso portion made of scent-absorbing material and including a front portion and a back portion, the front and back portions convertable between a first configuration wherein the torso portion worn by the individual and a second configuration wherein the torso portion forms a blanket;

a connection structure for releasably maintaining the front and the back portions of the torso portion in the first configuration;

a sleeve removably attached to the torso portion by a sleeve connector; and a seam connector structure for forming a longitudinal seam in the sleeve;

wherein by removing the sleeve from the torso portion and configuring the torso portion in the second configuration, the blanket formed is free of straps projecting therefrom.

6. The shirt-like garment of claim 1 wherein the connection structure includes a hook and pile fastener.

7. The shirt-like garment of claim 5 wherein the sleeve connector includes a hook and pile fastener.

8. The shirt-like garment of claim 5 wherein the seam connector structure includes a hook and pile fastener.

9. The shirt-like garment of claim 7 wherein the sleeve includes an end portion which is openable to form an infant's hood of the infant's blanket.

10. A shirt-like garment which is convertible to form one or more blankets for a baby, the shirt-like garment being adapted to be worn by an individual comprising:

a torso portion made of scent-absorbing material and including a front portion and a back portion, the front and back portions being dimensionally appropriate for use as a second blanket;

a sleeve of scent-absorbing material removably attached to the torso portion and having a longitudinal seam, the sleeve openable along the longitudinal seam for use as an infant's blanket;

a connection structure for releasably interconnecting the front and the back portions of torso portion; and seam connection structure forming the longitudinal seam of the sleeve;

wherein the first and second blankets are free of straps projecting therefrom.

11. The shirt-like garment of claim 10 wherein the connection structure includes a hook and pile fastener.

12. The shirt-like garment of claim 10 further comprising a seam connection structure for forming the longitudinal seam of the sleeve.

13. The shirt-like garment of claim 12 wherein the seam connection structure includes a hook and pile fastener.

14. The shirt-like garment of claim 10 wherein the sleeve includes an end portion which is openable to form an infant's hood of the second blanket.

15. The shirt-like garment of claim 9 wherein the sleeve may be removed from the torso portion and opened along the longitudinal seam to form a second blanket.

* * * * *